US006736713B2

(12) United States Patent
Lougher et al.

(10) Patent No.: US 6,736,713 B2
(45) Date of Patent: May 18, 2004

(54) WORKPIECE CARRIER RETAINING ELEMENT

(75) Inventors: Wayne F. Lougher, Phoenix, AZ (US); Frank McPeek, Tempe, AZ (US); Robert Key, Phoenix, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 241 days.

(21) Appl. No.: 09/924,067

(22) Filed: Aug. 7, 2001

(65) Prior Publication Data

US 2002/0037693 A1 Mar. 28, 2002

Related U.S. Application Data

(60) Provisional application No. 60/223,864, filed on Aug. 8, 2000.

(51) Int. Cl.[7] ..... B24B 7/00; B24B 9/00

(52) U.S. Cl. ..... 451/398; 451/388; 451/290

(58) Field of Search ..... 451/285–290, 451/397, 398

(56) References Cited

U.S. PATENT DOCUMENTS 5,643,061 A * 7/1997 Jackson et al. ..... 451/289
6,093,089 A * 7/2000 Chen et al. ..... 451/288
6,113,468 A * 9/2000 Natalicio ..... 451/41
6,116,992 A * 9/2000 Prince ..... 451/286
6,206,758 B1 * 3/2001 Lai et al. ..... 451/41
6,224,472 B1 5/2001 Lai et al.
6,251,215 B1 6/2001 Zuniga et al.
6,267,655 B1 * 7/2001 Weldon et al. ..... 451/307
6,585,850 B1 * 7/2003 Kenji et al. ..... 156/345.12

* cited by examiner

*Primary Examiner*—Timothy V. Eley
(74) *Attorney, Agent, or Firm*—Snell & Wilmer L.L.P.

(57) ABSTRACT

A wafer carrier retaining ring includes a first annular surface that contacts a polishing surface during a polishing process and an inner diameter surface adjoining the first annular surface thereby forming a first annular corner. The first annular corner has a radius in the range of from no less than about 0.010 inches to less than a radius that would result in damage to a wafer being polished. In another embodiment of the invention, a wafer carrier retaining ring includes an inner diameter surface and a second annular surface adjoining said inner diameter surface thereby forming a second annular corner. The second annular corner has a radius of no less than 0.030 inches. In a further embodiment of the invention, a wafer carrier retaining ring is formed of a ceramic material and has a first annular surface having a surface finish of no greater than 2 microinches rms.

13 Claims, 6 Drawing Sheets

WORKPIECE CARRIER RETAINING ELEMENT

CROSS REFERENCE TO RELATED APPLICATION

This application claims the benefit of U.S. Provisional Application No. 60/223,864, filed Aug. 8, 2000, the entire contents of which are hereby incorporated by reference.

FIELD OF THE INVENTION

The present invention relates, generally, to systems for polishing or planarizing workpieces such as semiconductor wafers. More particularly, the present invention relates to an apparatus for improving the uniform polishing of workpieces where the apparatus comprises a workpiece retaining element that engages a workpiece against a polishing surface during a polishing procedure.

BACKGROUND OF THE INVENTION

Many electronic and computer-related products such as semiconductors, CD-ROMs, and computer hard disks, require highly polished surfaces in order to achieve optimum operational characteristics. For example, high-quality and extremely precise wafer surfaces are often needed during the production of semiconductor-based integrated circuits. During the fabrication process, the wafers generally undergo multiple masking, etching and dielectric and conductor deposition processes. Because of the high-precision required in the production of these integrated circuits, an extremely flat surface is generally needed on at least one side of the semiconductor wafer to ensure proper accuracy and performance of the microelectronic structures created on the wafer surface. As the size of integrated circuits decreases and the density of microstructures on integrated circuits increases, the need for accurate and precise wafer surface polishing increases.

Chemical Mechanical Polishing ("CMP") machines have been developed to. polish or planarize semiconductor wafer surfaces to the flat condition desired for integrated circuit components and the like. For examples of conventional CMP processes and machines, see U.S. Pat. No. 4,805,348, issued Feb. 21, 1989 to Arai et al.; U.S. Pat. No. 4,811,522, issued Mar. 14, 1989 to Gill; U.S. Pat. No. 05,099,614, issued Mar. 31, 1992 to Arai et al.; U.S. Pat. No. 5,329,732, issued Jul. 19, 1994 to Karlsrud et al.; U.S. Pat. No. 5,498,196, issued Mar. 12, 1996 to Karlsrud et al.; U.S. Pat. No. 5,498,199, issued Mar. 12, 1996 to Karisrud et al.; U.S. Pat. No. 5,558,568, issued Sep. 24, 1996 to Talieh et al.; and U.S. Pat. No. 5,584,751, issued Dec. 17, 1996 to Kobayashi et al.

Typically, a CMP machine includes a wafer carrier configured to hold, rotate, and transport a wafer during the process of polishing or planarizing the wafer. The wafer carrier is rotated to cause relative lateral motion between the polishing surface and the wafer to produce a substantially uniform thickness. In general, the polishing surface includes a horizontal polishing pad that has an exposed abrasive surface of cerium oxide, aluminum oxide, fumed/precipitated silica, or other particulate abrasives. Commercially available polishing pads may utilize various materials, as is known in the art. Typically, polishing pads may be formed from a blown polyurethane, such as the IC and GS series of polishing pads available from Rodel Products Corporation in Phoenix, Arizona. The hardness and density of the polishing pad depends on the material that is to be polished and the degree of precision required in the polishing process.

During a polishing operation, a pressure element (e.g., a rigid plate, a bladder assembly, or the like), which may be integral to the wafer carrier, applies pressure such that the wafer engages the polishing surface with a desired amount of force. The carrier and the polishing pad are rotated, typically at different rotational velocities, to cause relative lateral motion between the polishing pad and the wafer to promote uniform polishing. Most conventional carrier assemblies include some form of retaining structure that maintains the position of the wafer under the pressure element during polishing. Prior art carrier assemblies designed for compatibility with circular wafers employ round retaining structures such as retaining rings.

Retaining rings may either be fixed or "floating" within the wafer carrier. For example, U.S. Pat. No. 5,695,392, issued Dec. 9, 1997 to Kim, discloses the use of a fixed retaining ring collar that is bolted to the main carrier housing. U.S. Pat. No. 5584,751, issued Dec. 17, 1996 to Kobayashi et al., and U.S. Pat. No. 5,795,215, issued Aug. 18, 1998 to Guthrie et al., each teach the use of a floating retaining ring and a pressure regulating mechanism that controls the biasing pressure applied to the retaining ring.

Typically, retaining rings are made from engineering polymers such as, for example, acetal homopolymer, acetal copolymer, and polyphenylene sulfide. These materials are prone to wear due to the friction between the wafer, polishing pad and slurry abrasives that are used during polishing of the wafer. Wearing of the materials that comprise the retaining rings results in shortening the lives of the retaining rings which are functional and necessary components of the wafer carriers. Water absorption by the retaining rings can also distort dimensions of the acetal copolymers or homopolymers which comprise the retaining rings, thereby distorting the dimensions of the retaining rings themselves. Downtime associated with the repair or replacement of wafer retaining elements such as, for example, retaining rings, used in wafer carriers may be extremely undesirable, particularly if the workpiece throughput is critical.

An alternative to polymer retaining rings are retaining rings made of ceramic materials that are better able to withstand wear from friction created between the wafer and the retaining element, as well as abrasive slurries such as silicon dioxide and aluminum oxide. Because direct contact between the wafer and the retaining ring may result in damage to the wafer, prior art retaining rings may include a disposable liner positioned around the inside diameter of the retaining ring. The disposable liner is typically comprised of a material that is softer than the semiconductor wafer, for example, a polymer such as acetal copolymer or polybutyline terathalate (PBT) to prevent the retaining ring from damaging the wafer.

Despite their resistance to wear compared to retaining rings made from engineering polymers, ceramic retaining rings are still subject to chipping, cracking and other wear effects due to the friction between the wafer and the polishing pad, as well as from abrasive slurries. The surface of typical ceramic retaining rings may be relatively nonuniform, for example, having surface finishes of 6 to 8 microinches root mean square ("rms"). When subjected to the planarization process, ceramic particulates can be fractured from the nonuniform surface of the retaining ring. These ceramic particulates can cause scratches in the wafers that are being polished. Wafers that are scratched provide lower device yield and may be considered scrap, resulting in increased costs to the consumer. Further, the short lifetime of the retaining rings due to wear is significant in that the retaining rings are typically expensive consumable component parts of the CMP apparatus.

The inside diameter corners of the retaining ring at the anchor surface and polishing surface of the retaining ring are particularly susceptible to wearing and chipping. FIGS. 1A and 1B illustrate a conventional ceramic retaining ring 10 available in the prior art. Retaining ring 10 has a polishing surface 12, which contacts a polishing pad, an anchor surface 20, which contacts the wafer carrier, an inside diameter surface 16, and an annular groove 18 which is positioned along the inside diameter surface 16. Annular groove 18 has a depth "A" as measured from inside diameter surface 16 and is configured to receive a disposable liner (not shown). Retaining ring 10 also has at least one anchor bore 14 for receiving an anchor device, such as a screw or bolt, so that retaining ring 10 may be fixedly attached to a CMP wafer carrier. Although anchor bore 14 is shown in FIG. 1B as opening to anchor surface 20 to receive an anchor device previously inserted into a wafer carrier, anchor bore 14 may also be a through-hole which receives an anchor device for subsequent insertion into the wafer carrier to anchor the retaining ring thereto. A corner 22, which is the intersection of polishing surface 12 and inside diameter surface 16 of retaining ring 10, has a radius generally on the order of from approximately 0.002 inches to 0.005 inches. With a radius in this range, corner 22 is relatively "squared" in shape. During the planarization process, polishing surface 12 and corner 22 are put in contact with a polishing pad (not shown) and subjected to rotational, lateral and/or orbital motion relative to the polishing pad. The inventors have discovered that forces on retaining ring 10 from this motion can cause chipping of corner 22, resulting in ceramic particulates separating from retaining ring 10.

Another problem with conventional ceramic retaining rings is that they can cause wear of bladder assemblies that are used in some wafer carriers to urge the wafer against the polishing pad with a desired amount of force. FIG. 2 depicts a conventional wafer carrier 100 that uses such a bladder assembly. For the sake of clarity and brevity, wafer carrier 100 is illustrated in a simplistic manner without a number of components that may be present in a practical carrier. Typically, carrier 100 is mounted at the end of a rotatable and vertically movable drive shaft 102, and above a rotatable polishing surface, e.g., a polishing pad 104, affixed to a platen 105. Wafer carrier 100 includes a pressure element 108, a retaining ring 10, and a flexible bladder membrane 106 which surrounds a cavity 110. Cavity 110 is in fluid communication with a gas or fluid source (not shown) which, when activated, fills cavity 110 with gas or fluid and causes flexible bladder membrane 106 to urge a wafer 112 against polishing pad 104. As bladder membrane 106 expands due to the air or fluid in cavity 110, it contacts a corner 24 of retaining ring 10. Referring momentarily back to FIG. 1B, corner 24 is formed from the intersection of anchor surface 20 and inside diameter surface 16 and has a radius also generally on the order of from approximately 0.0020 inches. With a radius in this range, corner 24 also is relatively "squared" in shape. Consequently, bladder membrane 106 is worn by the friction caused by contact with corner 24. The inventors have discovered that such wear reduces the life of bladder membrane 106 and causes particulates from the bladder membrane 106 to separate from bladder membrane. These particulates can also result in scratches to wafer W.

Accordingly, there is a need for an apparatus for eliminating or reducing wear of workpiece carrier elements in order to optimize workpiece throughput rate and enhance uniform polishing of workpieces.

SUMMARY OF THE INVENTION

This summary of the invention section is intended to introduce the reader to aspects of the invention and is not a complete description of the invention. Particular aspects of the invention are pointed out in other sections hereinbelow, and the invention is set forth in the appended claims which alone demarcate its scope.

In accordance with an exemplary embodiment of the present invention, a wafer carrier retaining ring is provided. The wafer carrier retaining ring includes a first annular surface which contacts a polishing surface during a polishing process. The wafer carrier retaining ring also includes an inner diameter surface that adjoins the first annular surface thereby forming a first annular corner. The first annular corner has a radius in the range of from no less than about 0.010 inches to less than a radius that would result in damage to a wafer being polished.

In accordance with another exemplary embodiment of the present invention, a wafer carrier retaining ring has a first annular surface which contacts a polishing pad during a polishing process. The wafer carrier retaining ring is formed of a ceramic material and the first annular surface has a surface finish of no greater than about 2 microinches rms.

In accordance with a further embodiment of the invention, a wafer carrier retaining ring has a first annular surface which contacts a polishing pad during a polishing process. An inner diameter surface adjoins the first annular surface. The wafer carrier retaining ring includes a second annular surface that is positioned parallel to the first annular surface and that adjoins the inner diameter surface, thereby forming an annular corner. The annular corner has a radius of no less than 0.030 inches.

In accordance with yet another embodiment of the invention, a wafer carrier assembly is provided. The wafer carrier assembly includes a pressure element that is configured to press a wafer against a polishing surface. A retaining ring is mounted to the pressure element. The retaining ring comprises a first annular surface which contacts the polishing surface during a polishing process. An inner diameter surface adjoins the first annular surface thereby forming a first annular corner. The first annular corner has a radius in the range of from no less than about 0.010 inches to less than a radius that would result in damage to a wafer being polished.

In accordance with yet a further embodiment of the invention, a wafer carrier assembly has a pressure element configured to press a wafer against a polishing surface. A retaining ring is mounted to the pressure element. The retaining ring has an annular surface which contacts the polishing surface during a polishing process. The retaining ring is formed of a ceramic material and the annular surface has a surface finish no greater than about 2 microinches rms.

BRIEF DESCRIPTION OF THE DRAWINGS

Exemplary embodiments of the present invention will hereafter be described in conjunction with the appended drawing figures, wherein like designations denote like elements, and.

DESCRIPTION OF THE INVENTION

The subject invention relates generally to the polishing of workpieces such as semiconductor wafers. It will be understood, however, that the invention is not limited to a particular workpiece type or to a particular manufacturing or polishing environment.

Figure 1A:
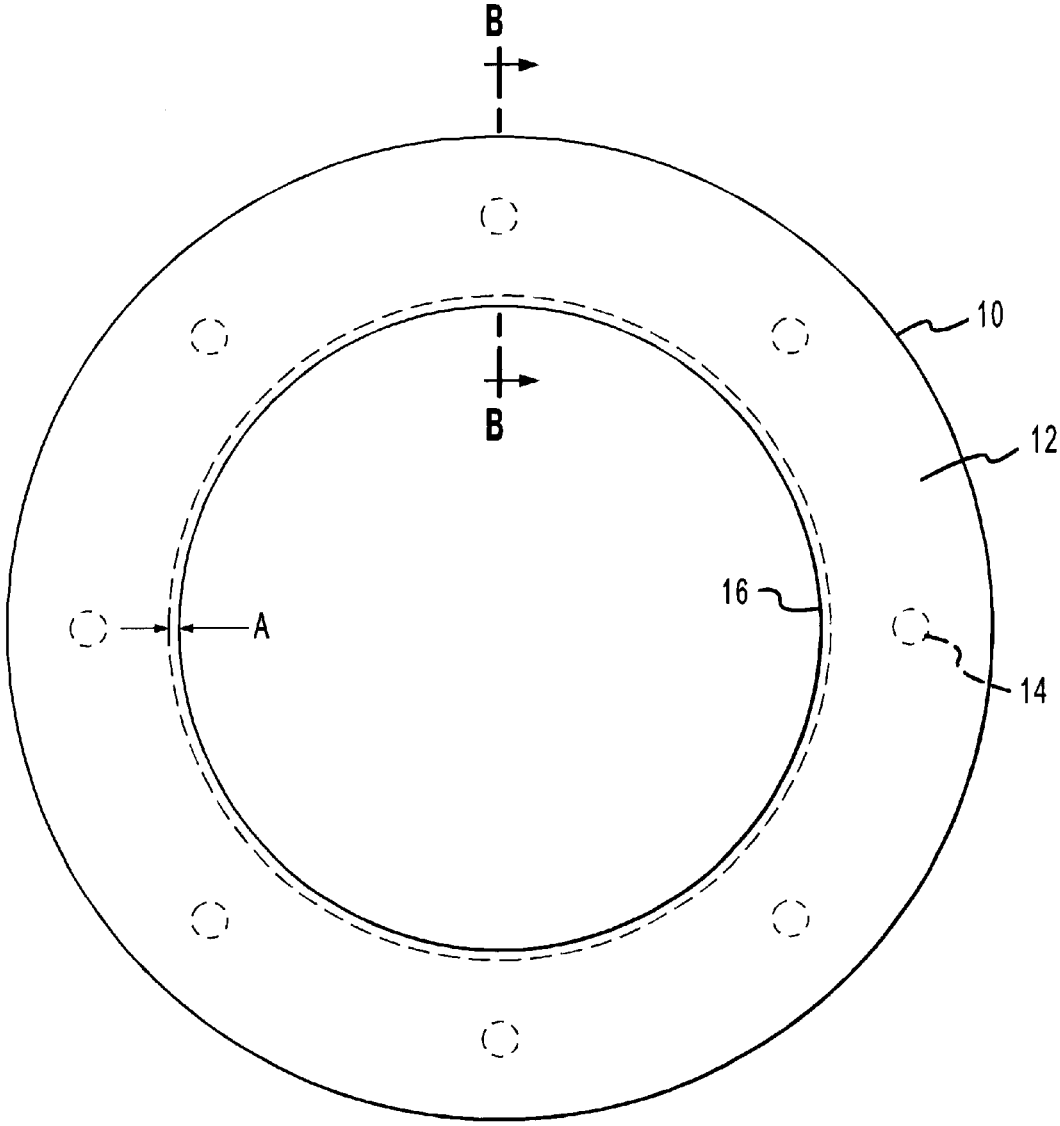
FIG.1A (PRIOR ART)
FIG. 1A is a top view of a prior art retaining ring for retaining a wafer within a wafer carrier apparatus.
Figure 1B:
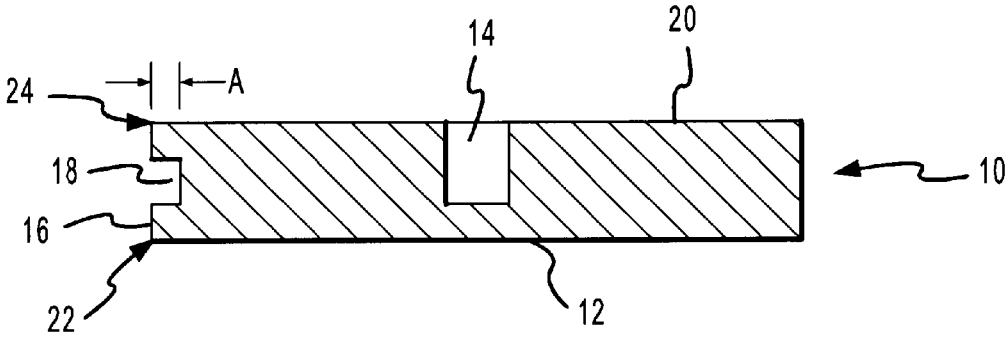
FIG.1B (PRIOR ART)
FIG. 1B is a side cross-sectional view of the retaining ring shown in FIG. 1A.
Figure 2:
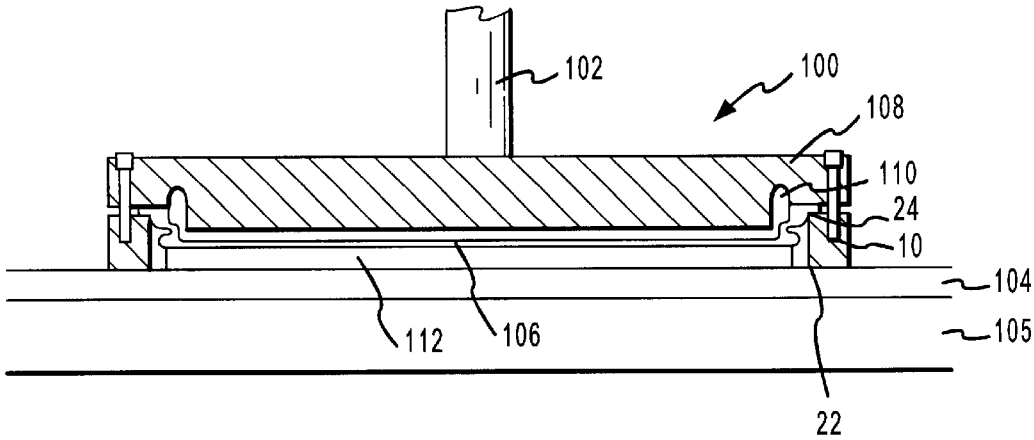
FIG.2 (PRIOR ART)
FIG. 2 is a side cross-sectional view of a prior art semiconductor wafer carrier apparatus which includes a flexible bladder assembly and a prior art retaining ring.
Figure 3:
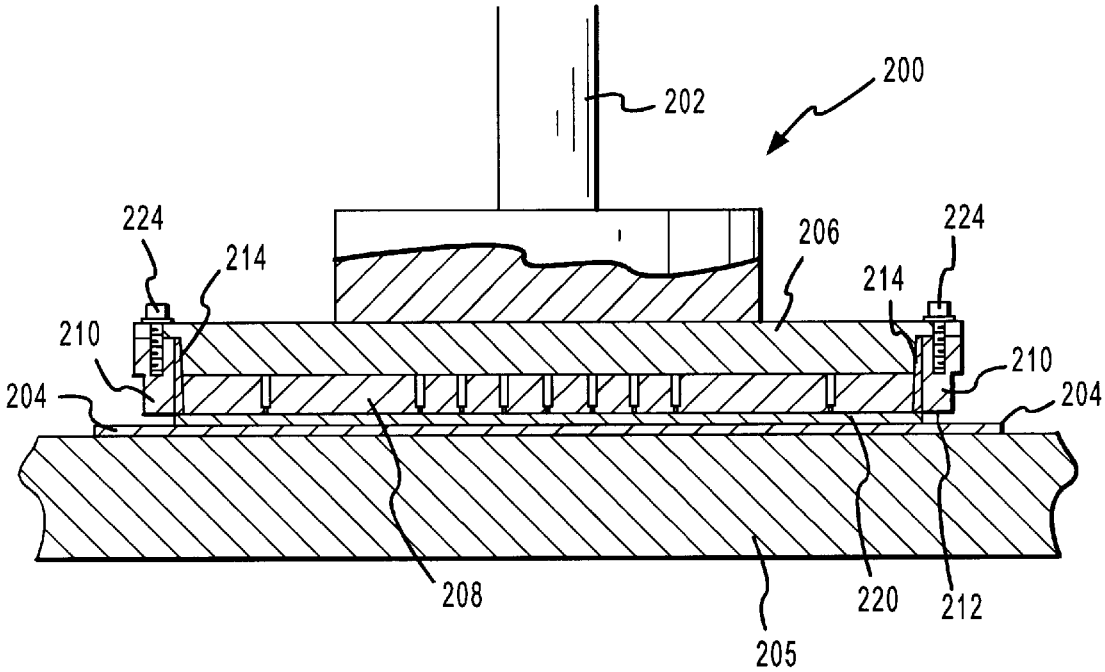
FIG. 3 is a side cross-sectional view of a semiconductor wafer carrier apparatus which includes an exemplary embodiment of the retaining structure of the present invention.

FIG. 3 depicts a wafer carrier 200 according to one embodiment of the present invention. For the sake of clarity and brevity, wafer carrier 200 is illustrated in a simplistic manner without a number of components that may be present in a practical carrier. A detailed description of the construction and operation of an exemplary CMP system may be found in U.S. Pat. No. 5,329,732, issued Jul. 19, 1994 to Karlsrud et al., the disclosure of which is incorporated by reference. Typically, carrier 200 is mounted at the end of a rotatable and vertically movable drive shaft 202, and above a rotatable polishing surface, e.g., a pad 204, affixed to a platen 205. Wafer carrier 200 and the above components are typically integral to a CMP machine or a similar workpiece polishing apparatus.

Wafer carrier 200 includes a pressure element 206, a protective wafer backing pad 208, a retaining ring 210 and a disposable liner 214. Pressure element 206 may be rigidly coupled to carrier 200 or movably coupled to carrier 200, depending upon the particular configuration of wafer carrier 200. For example, in the illustrated embodiment, pressure element 206 is configured as a rigid pressure plate that is fixed to at least a portion of carrier 200. It should be appreciated that the present invention may be embodied in the context of any number of practical wafer carrier designs, e.g., utilizing floating pressure plates and gimbal mechanisms, those utilizing fluid driven bladders or membranes instead of rigid pressure plates, those utilizing floating bladder assemblies, and those using any combination of such techniques.

In FIG. 3, pressure element 206 is a unitary component formed of a rigid material, such as steel. Pressure element 206 is configured to press a workpiece against polishing pad 204 during a polishing operation associated with the CMP system. Wafer carrier 200 may employ any number of known techniques to apply, regulate, and control the amount of pressure imparted by pressure element 206. A compliant wafer backing pad 208 is mounted to the lower surface of pressure element 206 to cushion wafers held thereby and to protect the wafers against damage which may result from direct contact with the pressure element 206. The rear face of the wafer or other workpiece 220 rests in parallel contact against wafer backing pad 208, while the front face of the workpiece 220 is exposed for parallel contact against the top surface of polishing pad 204. The wafer backing pad 208 prevents imperfections or material present on the rear face of the wafer from being "telegraphed" through the wafer to its front (polishing) face, which can result in uneven pressure distribution across the wafer front face against the polishing pad 204 which, in turn, can lead to uneven material removal rates and impaired planarization. The wafer backing pad 208 also frictionally engages the rear surface of the wafer 220, thereby preventing movement or sliding of the wafer 220 relative to the wafer backing pad 208. Wafer 220 may be held against protective wafer backing pad 208 by any convenient mechanism, such as, for example, by vacuum or by wet surface tension.

Circular retaining ring 210 is preferably connected around the periphery of protective wafer backing pad 208 and prevents wafer 220 from slipping laterally from beneath the protective wafer backing pad 208 as the wafer is polished. Retaining ring 210 is generally connected to pressure element 206 by an anchor device 224, such as a bolt, screw or other similar fixation device. Although anchor device 224 is shown in FIG. 3 as being inserted into retaining ring 210 from pressure element 206, it will be understood that anchor device 224 can also be inserted in the opposite direction, that is, into retaining ring 210 and then into pressure element 206. Retaining ring 210 is preferably comprised of a hard ceramic such as $Al_2O_3$, $Be_2C$, TiC, SiC, AIB, $B_4C$, cubic BN or diamond. In addition, the composition of the retaining ring 210 of the present invention is not limited to a single-phase material but may also include combinations of ceramic materials such as, for example, a two-phase composite material of $Al_2O_3$ reinforced with SiC or a SiC ceramic with A $1_2O_3$ and yttrium aluminum garnet (YAG) phases.

Polishing surface 212 of retaining ring 210 is polished to reduce the nonuniformity of the surface of the ceramic material. An increasingly planar ceramic polishing surface 212 has a larger surface area in contact with the polishing pad 204 and consequently localized stresses are reduced. A relatively rough surface has more peaks and nonuniformities that contact the polishing pad and may break off from the wafer during polishing. Accordingly, polishing surface 212 of retaining ring 210 has a surface finish of approximately less than 2 microinches rms, and preferably less than about 1 microinch rms. With a surface finish in this range, chipping and cracking of retaining ring 210 is reduced, thereby reducing the scratching of wafer 220 by free ceramic particulates.

During the CMP procedure, polishing pad 204 is located below wafer carrier 200 on a polishing platen 205 that is configured to move in a rotational, orbital or linear motion. The hardness and density of the pad are selected based on the type of polishing process required. Blown polyurethane pads, such as the IC and GS series of pads available from Rodel Products Corporation of Phoenix, Ariz., may be advantageously utilized by the CMP system. An abrasive slurry, such as an aqueous slurry of silica particles, is typically pumped onto the polishing pad 204 during a polishing operation. The relative movements of wafer carrier 200 and polishing pad 204, augmented by the abrasive action of the slurry, produce a combined chemical and mechanical process at the exposed (lower) face of a wafer 220 (which is located under pressure element 206 ) which removes projections and irregularities to produce a substantially flat or planar surface on the lower side of the wafer 220.

Figure 4:
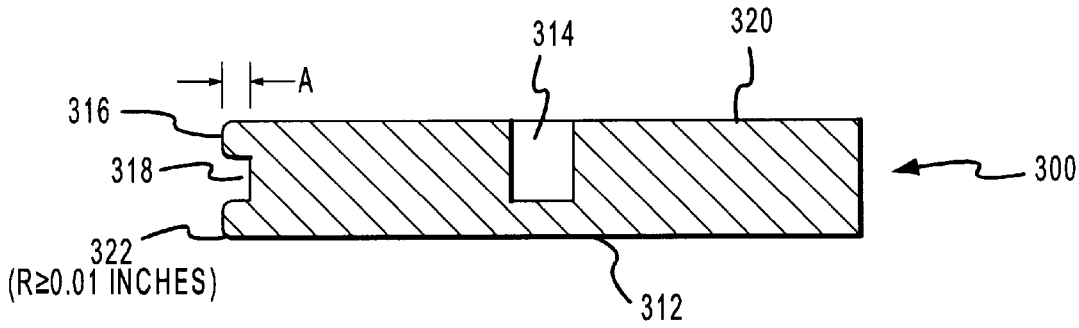
FIG. 4 is a side cross-sectional view of the retaining structure of the wafer carrier apparatus shown in FIG. 3.

In a further exemplary embodiment of the present invention, as seen in FIG. 4, a retaining ring 300 as may be used in conjunction with wafer carrier 200 has a polishing surface 312, which contacts a polishing pad during a CMP process. Retaining ring 300 also includes an anchor surface 320 which contacts the wafer carrier 200, an inside diameter surface 316, and an annular groove 318 which is positioned along the inside diameter surface 316. Annular groove 318 has a depth "A" as measured from inside diameter surface 316 and is configured to receive a disposable liner (not shown). Retaining ring 300 also has at least one anchor bore 314 for receiving an anchor device, such as a screw, bolt or other fixation device, so that retaining ring 300 may be fixedly attached to the wafer carrier. While illustrated in FIG. 4 as opening to anchor surface 320 to receive an anchor device 224 previously inserted into pressure element 206 of FIG. 3, it will be understood that anchor bore 314 may be configured in a countersink fashion to receive an anchor device that is subsequently inserted into pressure element 206 to anchor retaining ring 300 thereto. Alternatively, retaining ring 300 may be anchored to pressure element 206 of wafer carrier 200 by any other suitable mechanism.

An annular corner 322, which is the intersection of polishing surface 312 and inside diameter surface 316 of retaining ring 300, has a radius generally greater than or equal to about 0.010 inches but less than that radius that would result in wafer loss. If the radius of annular corner 322 is too large, the wafer may slip between the retaining ring and the polishing pad and chip or break, or may slip out from beneath the wafer carrier altogether. Preferably, the radius of annular corner 322 ranges from approximately 0.010 inches to approximately 0.025 inches, and more preferably ranges from approximately 0.013 inches to approximately 0.020 inches. With a radius in this range, annular corner 322 is more "rounded" in shape than in prior art retaining rings. Accordingly, annular corner 322 is less susceptible to cracking and chipping than prior art ceramic retaining rings.

Testing of the polished ceramic retaining ring of the present invention was conducted to determine the effectiveness in reducing adder defects on semiconductor wafers relative to standard ceramic retaining rings. Adder defects are defects caused by the polishing process. The number of adder defects is calculated by subtracting the number of defects present before polishing from the number of defects present after polishing. A standard retaining ring made from $Al_2O_3$ (Ring #1) with annular corner 322 in the range of between 0.002 inches and 0.005 inches was installed in a conventional CMP apparatus. Approximately 60 semiconductor wafers were serially polished using conventional CMP process conditions. Microscopic measurements were then taken to determine the number of adder defects of greater than 0.20 $\mu$m and greater than 0.1 6 $\mu$m on the wafers. The measurements were analyzed to determine if the number of adder defects on the wafers decreased relative to the number of times the ceramic retaining ring had been used in the CMP apparatus. A polished ceramic retaining ring in accordance with the present invention (Ring #3), with a surface finish of approximately 0.7 microinches rms and a corner 322 with a radius in the range of approximately 0.013 inches to 0.020 inches, was then installed on the same CMP apparatus. Semiconductor wafers were polished under the same polishing conditions as those used for the wafers polished using the standard retaining ring. Again, microscopic measurements were taken to determine the number of adder defects of greater than 0.20 $\mu$m and greater than 0.16 $\mu$m on the wafers. The measurement were then analyzed to determine if the number of adder defects on the wafers changed relative to the number of times the polished ceramic retaining ring had been used in the CMP apparatus. Below is a table of the testing results:

| WAFER NUMBER | RING NUMBER | 0.20 $\mu$m Adder Defects | 0.16 $\mu$m Adder Defects |
|---|---|---|---|
| 1 | 1 | 2734 | 5823 |
| 5 | 1 | 1473 | 3617 |
| 10 | 1 | 150 | 418 |
| 20 | 1 | 45 | 109 |
| 25 | 1 | 58 | 145 |
| 30 | 1 | 66 | 161 |
| 35 | 1 | 77 | 159 |
| 40 | 1 | 39 | 95 |
| 45 | 1 | 31 | 103 |
| 50 | 1 | 44 | 99 |
| 55 | 1 | 23 | 82 |
| 60 | 1 | 73 | 138 |
| 71 | 3 | 715 | 1322 |
| 75 | 3 | 52 | 158 |
| 80 | 3 | 6 | 30 |
| 90 | 3 | 34 | 70 |
| 100 | 3 | 10 | 29 |
| 110 | 3 | 3 | 19 |
| 120 | 3 | −5 | −6 |

As can be seen from the above table, the number of adder defects measured on the first wafer (wafer #71) polished using the polished ceramic retaining ring of the present invention was significantly less than the number of adder defects measured on the first wafer (wafer #1) polished using the standard retaining ring. The number of adder defects measured from the wafers polished using the standard ceramic retaining ring was still significant even after the retaining ring had been used to polish 60 wafers. In contrast, the number of measured adder defects from wafers planarized using the polished ceramic retaining ring dropped significantly after the polished ceramic retaining ring of the present invention had been used only five times (compare wafer #71 to wafer #75). Wafer #120 experienced a negative number of adder defects, that is, wafer #120 had more defects before polishing than after polishing.

Figure 5:
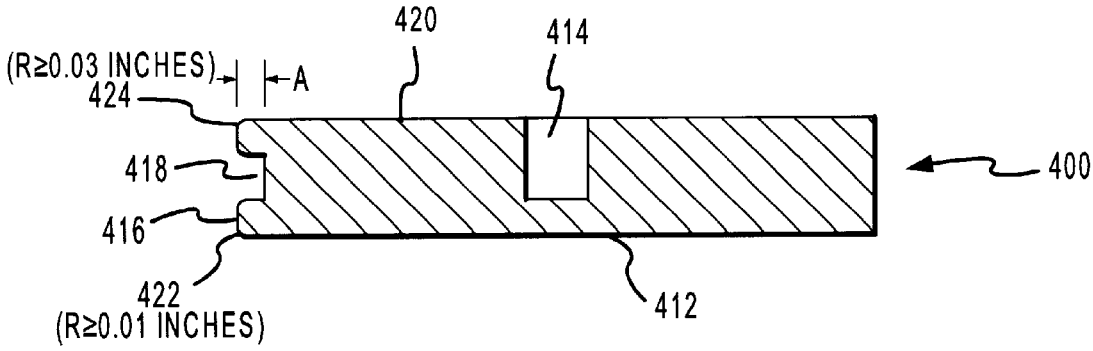
FIG. 5 is a side cross-sectional view of another embodiment of the retaining structure of the present invention.
Figure 6:
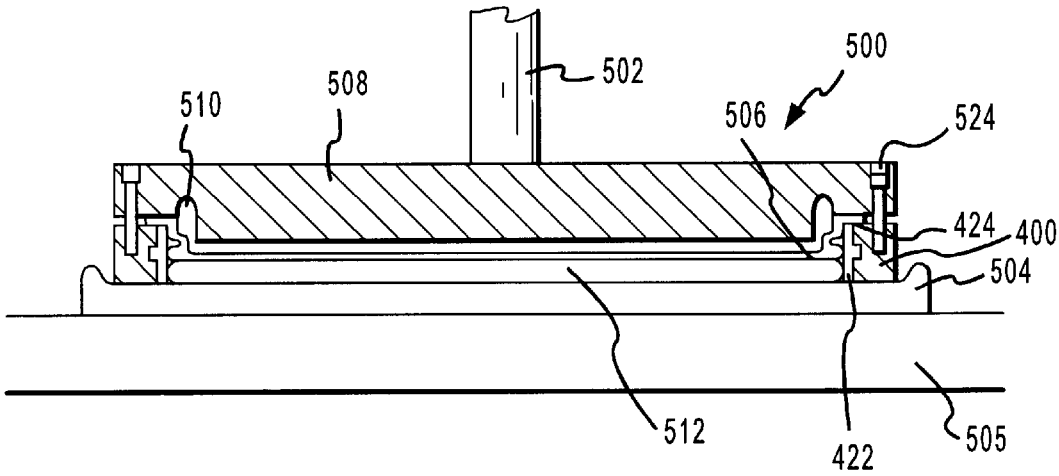
FIG. 6 is a side cross-sectional view of a semiconductor wafer carrier apparatus which includes the retaining structure shown in FIG. 5.

FIGS. 5 and 6 depict a wafer carrier 500 according to another embodiment of the present invention. Again for the sake of clarity and brevity, wafer carrier 500 is illustrated in a simplistic manner without a number of components that may be present in a practical carrier. Typically, carrier 500 is mounted at the end of a rotatable and vertically movable drive shaft 502, and above a rotatable polishing surface, e.g., a pad 504, affixed to a platen 505. Wafer carrier 500 includes a pressure element 508, a retaining ring 400, and a flexible bladder membrane 506 which surrounds a cavity 510. Cavity 510 is in fluid communication with a gas or fluid source (not shown) which, when activated, fills cavity 510 with gas or fluid and causes flexible bladder membrane 506 to urge a wafer 512 against polishing pad 504. A detailed description of the construction and operation of an exemplary CMP system using a bladder assembly may be found in U.S. Pat. No. 6,056,632, issued May 2, 2000 to Mitchel et al., the disclosure of which is incorporated by reference.

Circular retaining ring 400 is generally connected to pressure element 508 by anchor devices 524, such as bolts, screws or other fixation devices, to prevent wafer 512 from slipping laterally from beneath the flexible bladder membrane 506 as the wafer is polished. Retaining ring 400 is preferably comprised of a hard ceramic such as $Al_2O_3$, $Be_2C$, TiC, SiC, AIB, $B_4C$, cubic BN or diamond. The composition of the retaining ring 400 of the present invention is not limited to a single-phase material but may also include combinations of ceramic materials such as, for example, a two-phase composite material of $Al_2O_3$ reinforced with SiC or a SiC ceramic with $Al_2O_3$ and YAG phases.

As seen in FIG. 5, retaining ring 400 has a polishing surface 412, which contacts polishing pad 504. Retaining ring 400 also includes an anchor surface 420 which is positioned proximate pressure element 508, an inside diameter surface 416, and an annular groove 418 which is positioned along the inside diameter surface 416. Annular groove 418 has a depth "A" as measured from inside diameter surface 416 and is configured to receive a disposable liner 422, as shown in FIG. 6. Retaining ring 400 also has at least one anchor bore 414 for receiving an anchor device, such as a screw, bolt or other fixation device, so that retaining ring 400 may be fixedly attached to the wafer carrier 500. While illustrated in FIG. 5 as opening to anchor surface 420 to receive an anchor device previously inserted into pressure element 508 of FIG. 6, it will be understood that anchor bore 414 may be configured in the opposite manner, that is, in a countersink fashion to receive an anchor device that is subsequently inserted into pressure element 508 to anchor retaining ring 400 thereto. Alternatively, retaining ring 400 may be mounted to pressure element 508 of wafer carrier 500 by any other suitable mechanism.

Retaining ring 400 is polished on surface 412 to reduce the nonuniformity of the surface of the ceramic material. Surface 412 of retaining ring 400 is polished to a surface finish of approximately less than 2 microinches rms, and preferably less than about 1 microinch rms. An annular corner 422, which is the intersection of polishing surface 412 and inside diameter surface 416 of retaining ring 400 has a radius generally not less than about 0.010 inches but no greater than that radius that would result in wafer loss. Preferably, the radius of annular corner 422 ranges from approximately 0.010 inches to approximately 0.025 inches, and preferably from approximately 0.013 inches to approximately 0.020 inches. An annular corner 424, which is the intersection of anchor surface 420 and inside diameter surface 416 of retaining ring 400, has a radius generally of no less than about 0.030 inches. Preferably, the radius is no less than about 0.04 inches and more preferably ranges from approximately 0.040 inches to approximately 0.060 inches. With a radius in this range, annular corner 424 is more "rounded" in shape than in prior art retaining rings. Accordingly, wear of flexible bladder membrane 506 is reduced.

Although the subject invention has been described herein in conjunction with the appended drawing figures, it will be appreciated that the scope of the invention is not so limited. Various modifications in the arrangement of the components discussed and the steps described herein for using the subject device may be made without departing from the spirit and scope of the invention.

We claim:

1. A wafer carrier retaining ring, comprising:

a first annular surface which contacts a polishing surface during a polishing process; and an inner diameter surface adjoining said first annular surface thereby forming a first annular corner:

wherein said first annular corner has a radius in the range of from about 0.010 inches to about 0.025 inches.

2. The wafer carrier retaining ring of claim 1, wherein said first annular corner has a radius in the range of from about 0.013 inches to about 0.020 inches.

3. The wafer carrier retaining ring of claim 1, further comprising:

a second annular surface adjoining said inner diameter surface thereby forming a second annular corner, wherein said second annular corner has a radius no less than about 0.030 inches.

4. The wafer carrier retaining ring of claim 3, wherein said second annular corner has a radius no less than about 0.040 inches.

5. The wafer carrier retaining ring of claim 4, wherein said second annular corner has a radius in the range of from about 0.040 inches to about 0.060 inches.

6. The wafer carrier retaining ring of claim 1, further comprising an annular groove positioned proximate said inner diameter surface and configured to received a disposable liner.

7. A wafer carrier assembly, comprising:

a pressure element configured to press a wafer against a polishing surface; and a retaining ring mounted to said pressure element, said retaining ring comprising:

a first annular surface which contacts said polishing surface during a polishing process; and an inner diameter surface adjoining said first annular surface thereby forming a first annular corner;

wherein said first annular corner has a radius in the range of from about 0.01 inches to about 0.025 inches.

8. The wafer carrier assembly of claim 7, wherein said first annular corner has a radius in the range of from about 0.013 inches to about 0.020 inches.

9. The wafer carrier assembly of claim 7, said retaining ring further comprising:

a second annular surface adjoining said inner diameter surface thereby forming a second annular corner, wherein said second annular corner has a radius no less than about 0.030 inches.

10. The wafer carrier assembly of claim 9, wherein said second annular corner has a radius no less than 0.040 inches.

11. The wafer carrier assembly of claim 10, wherein said second annular corner has a radius in the range of from about 0.040 inches to about 0.060 inches.

12. The wafer carrier assembly of claim 7, said retaining ring further comprising an annular groove positioned proximate said inner diameter surface and configured to received a disposable liner.

13. A wafer carrier retaining ring comprising;

a first annular surface which contacts a polishing pad during a polishing process;

an inner diameter surface adjoining said first annular surface;

a second annular surface positioned parallel to said first annular surface and adjoining said inner diameter surface thereby forming an annular corner having a radius in a range of from about 0.040 inches to about 0.060 inches;

wherein said annular corner has a radius of no less than 0.040 inches.

* * * * *